US011225392B2

(12) United States Patent
Tanaka et al.

(10) Patent No.: US 11,225,392 B2
(45) Date of Patent: Jan. 18, 2022

(54) WOUND THREAD PACKAGE AND MANUFACTURING METHOD FOR SAME

(71) Applicant: UBE EXSYMO CO., LTD., Tokyo (JP)

(72) Inventors: Seiji Tanaka, Tokyo (JP); Yasushi Kato, Tokyo (JP); Kousuke Kanno, Tokyo (JP); Kazuyoshi Shimizu, Tokyo (JP)

(73) Assignee: UBE EXSYMO CO., LTD., Tokyo (JP)

( * ) Notice: Subject to any disclaimer, the term of this patent is extended or adjusted under 35 U.S.C. 154(b) by 149 days.

(21) Appl. No.: 16/496,675

(22) PCT Filed: Mar. 23, 2018

(86) PCT No.: PCT/JP2018/011636
§ 371 (c)(1),
(2) Date: Sep. 23, 2019

(87) PCT Pub. No.: WO2018/186202
PCT Pub. Date: Oct. 11, 2018

(65) Prior Publication Data

US 2020/0399092 A1 Dec. 24, 2020

(30) Foreign Application Priority Data

Apr. 6, 2017 (JP) ..... JP2017-076317

(51) Int. Cl.
*B65H 55/00* (2006.01)
*B65H 54/02* (2006.01)
(Continued)

(52) U.S. Cl.
CPC ..... *B65H 55/005* (2013.01); *B65H 54/02* (2013.01); *B65H 54/28* (2013.01); *B65H 55/04* (2013.01);
(Continued)

(58) Field of Classification Search
CPC .... B65H 55/005; B65H 55/04; B65H 57/006; B65H 57/04; B65H 54/28; B65H 2701/31
See application file for complete search history.

(56) References Cited

U.S. PATENT DOCUMENTS 4,509,702 A * 4/1985 Reese ..... B65H 54/026 242/157 R
8,882,019 B2 * 11/2014 Bourgeoisat ..... B65H 54/2812 242/472.8
(Continued)

FOREIGN PATENT DOCUMENTS

EP 0269213 A2 6/1988
JP S63-99345 A 4/1988
(Continued)

OTHER PUBLICATIONS

International Search Report for corresponding international application PCT/JP2018/011636 dated Jun. 12, 2018, citing the above references.

*Primary Examiner* — William E Dondero
(74) *Attorney, Agent, or Firm* — Hauptman Ham, LLP

(57) ABSTRACT

There is provided a wound thread package that is unlikely to cause problems such as cob-webbing and collapse at the time of unwinding even when the wound thread is a multi-filament thread or tape-like thread, and a manufacturing method for the same.
To manufacture a wound thread package 1 by winding a plurality of multi-filament threads or tape-like threads having a total fineness of 100 to 6400 dtex per thread around a bobbin 2 by a traverse method, the threads constituting a thread layer 3 are arranged at intervals therebetween and wound with the same in traverse width w and at different traverse reverse positions.

8 Claims, 8 Drawing Sheets

(51) Int. Cl.

| | |
|---|---|
| ***B65H 55/04*** | (2006.01) |
| ***B65H 57/28*** | (2006.01) |
| ***B65H 57/04*** | (2006.01) |
| ***B65H 57/00*** | (2006.01) |
| ***B65H 54/28*** | (2006.01) |

(52) U.S. Cl.
CPC ..... *B65H 57/006* (2013.01); *B65H 57/04* (2013.01); *B65H 57/28* (2013.01); *B65H 2701/31* (2013.01)

(56) References Cited

U.S. PATENT DOCUMENTS

| | | | | |
|---|---|---|---|---|
| 2012/0111983 | A1* | 5/2012 | Bourgeoisat ..... | B65H 55/005 242/166 |
| 2013/0284848 | A1 | 10/2013 | Hashimoto | |

FOREIGN PATENT DOCUMENTS

| | | | |
|---|---|---|---|
| JP | H11-193179 | A | 7/1999 |
| JP | 2000-203761 | A | 7/2000 |
| JP | 2006-240881 | A | 9/2006 |
| JP | 2011-207597 | A | 10/2011 |
| JP | 2012154000 | A | 8/2012 |
| JP | 2013133576 | A | 7/2013 |
| WO | 2012/096040 | A1 | 7/2012 |

* cited by examiner

WOUND THREAD PACKAGE AND MANUFACTURING METHOD FOR SAME

CROSS REFERENCE TO RELATED APPLICATION

This application claims the priority of Japanese Patent Application No. 2017-076317, filed on Apr. 6, 2017, in the JPO (Japanese Patent Office). Further, this application is the National Phase Application of International Application No. PCT/JP2018/011636, filed on Mar. 23, 2018, which designates the United States and was published in Japan. Both of the priority documents are hereby incorporated by reference in their entireties.

TECHNICAL FIELD

The present invention relates to a wound thread package in which a thread is wound around a bobbin and a manufacturing method for the same. More specifically, the present invention relates to a technique for manufacturing a wound thread package by traverse-winding a multi-filament thread or tape-like thread around a bobbin.

BACKGROUND ART

In general, in order to wind a tape-like or thread-like linear material around a core material such as a bobbin to form a package, the traverse winding method is used to wind the linear material around a core while running the linear material back and forth in the axial direction of the core. However, in the traverse winding method, the density of the thread concentrates at the turning positions so that the formed package tends to have the both end parts bulging and protruding beyond the center part as seen in the axial direction of the bobbin.

While unwound from the package with the both end parts bulging, the linear material may come off and reside outside the package. In this state, during the unwinding, such a delivery failure may occur or the linear material may be broken due to a hitch or entanglement. Such collapse at the time of unwinding of the package becomes prominent when the linear material is thick. As for general-purpose synthetic fibers, this phenomenon is often seen in fibers with a total fineness of 100 dtex or more per fiber or in fibers of a dimension equivalent to this, and is more pronouncedly seen in fibers with a total fineness of 1000 dtex or more per fiber.

To prevent the bulging of the both end parts, the pressure of a contact roller (contact pressure) can be increased. According to this method, however, the thread is pushed out of the lower side of the thread layer at both end parts and the package has the both end surfaces swelling, so that the thread may come into a state called "cob-webbing" in which the wound thread takes a short-cut and comes off from the end parts. The package shape with the both end parts bulging and the package shape with the both end surfaces swelling are in a relationship that, when one is prioritized, the other becomes prominent. Accordingly, in general, conditions are adjusted while striking the balance between the two package shapes.

There has been conventionally proposed a method for unwinding a thread from a high-selvage package with end parts bulging without causing a thread breakage (see Patent Literature 1). In addition, there have been also proposed winding methods by which a traverse width is temporarily narrowed by repetition to prevent an increase in the thread density at the both end parts of the package (refer to Patent Literatures 2 to 4).

CITATION LIST

Patent Literature

Patent Literature 1: Japanese Unexamined Patent Application Publication 2006-240881

Patent Literature 2: Japanese Unexamined Patent Application Publication 11-193179

Patent Literature 3: Japanese Unexamined Patent Application Publication 2000-203761

Patent Literature 4: International Publication 2012/096040

SUMMARY OF THE INVENTION

Technical Problem

However, the technique described in Patent Literature 1 is intended to solve trouble at the time of winding, not to improve a failure in a winding figure. Thus, it is not possible to manufacture a package without bulges at the both end parts by using the device described in Patent Literature 1. On the other hand, according to the devices described in Patent Literatures 2 to 4, winding is performed while adjusting the traverse width by changing the distance between the bobbin and the contact roller so as not to cause bulges at the both end parts of the package. According to this method, however, the traverse position cannot be accurately reversed at desired positions.

In particular, to wind a thread with as a large fineness as several thousands of dtex for synthetic fiber, thick thread is wound in an overlapping state at the traverse reverse positions, which tends to cause troubles at the time of unwinding. In addition, according to the techniques described in Patent Literatures 2 to 4, an additional control unit is required so that the entire device becomes complicated and expensive.

Thus, an object of the present invention is to provide a wound thread package that is unlikely to cause problems such as cob-webbing and collapse at the time of unwinding even when the wound thread is a multi-filament thread or tape-like thread, and a manufacturing method for the same.

Solution to Problem

A wound thread package according to the present invention includes: a bobbin; and a thread layer that is formed by winding a plurality of multi-filament threads or tape-like threads around the bobbin by a traverse method at intervals therebetween. The multi-filament threads and the tape-like threads have a total fineness of 100 to 6400 dtex per thread, and the threads wound around the bobbin are the same in traverse width and different in reverse position.

The thread layer may be configured such that the number of threads wound is smaller at both axially end parts than at an axially center part so that one or two or more steps are formed at the both axially end parts.

A manufacturing method for a wound thread package according to the present invention includes a winding step of winding a plurality of multi-filament threads or tape-like threads with a total fineness of 100 to 6400 dtex per thread around a bobbin by a traverse method at intervals therebetween. In the winding step, the threads are made the same in traverse width and are changed in reverse position from each other.

In the winding step, the number of threads wound at both axially end parts may be made smaller than the number of threads wound at an axially center part so that one or two or more steps are formed at the both axially end parts of the thread layer formed on the bobbin.

In this case, for example, m (m is a natural number of 2 or more) multi-filament threads or tape-like threads can be wound at the same time using a traverse guide having m or more grooves.

The interval between the grooves in the traverse guide can be set to 0.3 to 5 mm.

Advantageous Effects of Invention

According to the present invention, the number of threads wound at the both axially end parts is decreased, makes it possible to obtain a wound thread package that is less prone to cause problems such as cob-webbing and collapse at the time of unwinding without bulges at the both end parts even when the wound threads are multi-filament threads or tape-like threads.

BRIEF DESCRIPTION OF DRAWINGS

FIG. 4A illustrates a sheath-core composite type, FIG. 4B illustrates an eccentric sheath-core type, and FIG. 4C illustrates a side-by-side type.

DESCRIPTION OF EMBODIMENTS

Embodiments for carrying out the present invention will be described below in detail with reference to the attached drawings. Note that the present invention is not limited to the embodiments described below.

First Embodiment

Figure 1:
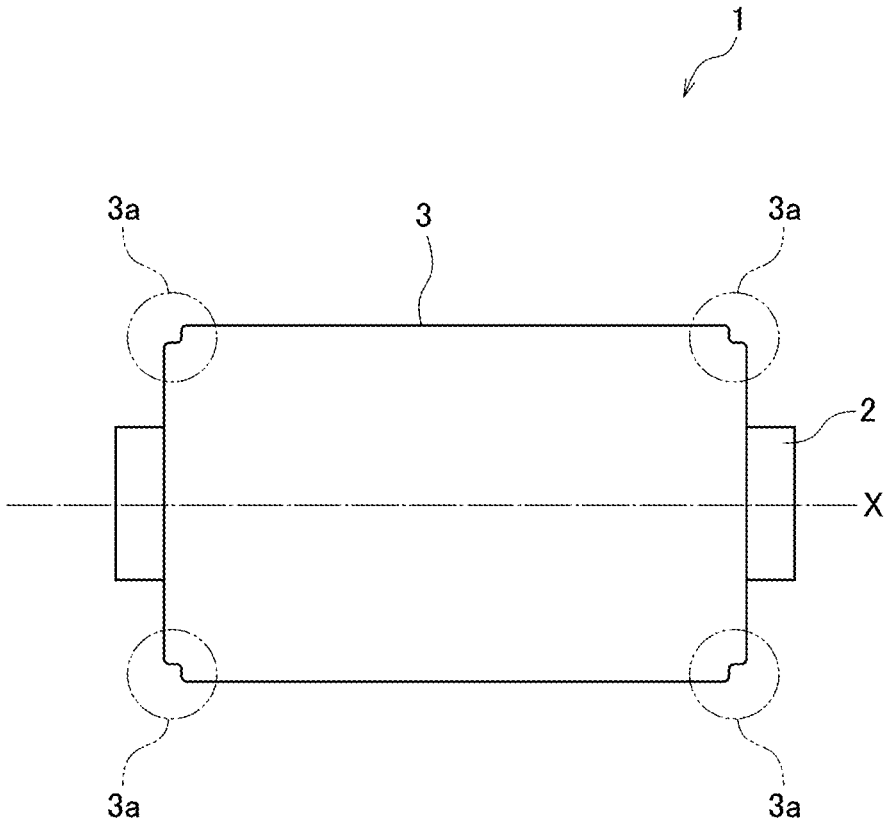
FIG. 1 is a side view of an outer shape of a wound thread package in a first embodiment of the present invention.
Figure 2:
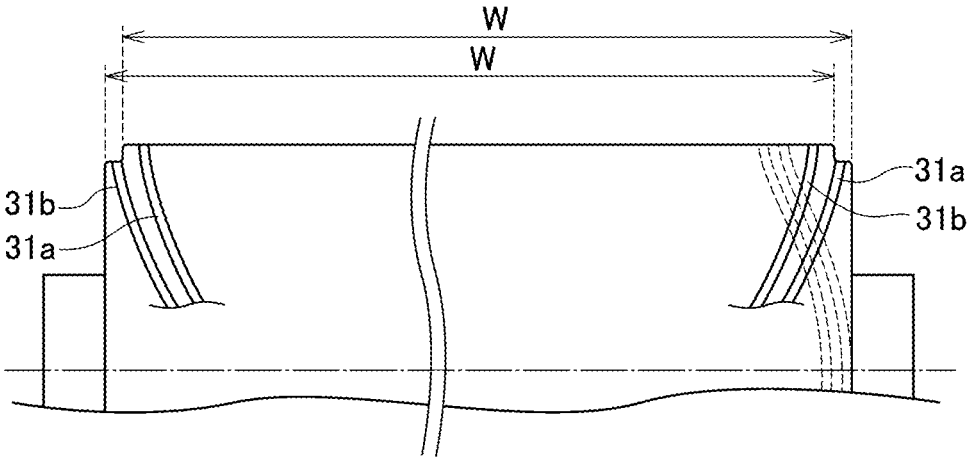
FIG. 2 is a schematic diagram illustrating a winding state at both end parts of the wound thread package 1 illustrated in FIG. 1.

First, a wound thread package according to a first embodiment of the present invention will be described. FIG. 1 is a side view of an outer shape of the wound thread package in the present embodiment. FIG. 2 is a schematic diagram illustrating a winding state at both end parts of the wound thread package. As illustrated in FIGS. 1 and 2, the wound thread package 1 in the present embodiment includes a bobbin 2 and a thread layer 3 formed on the bobbin 2.

[Bobbin 2]

The bobbin 2 can be a cylindrical object made from paper, plastic, or metal such as an aluminum alloy. There is no particular limitation on the size of the bobbin 2, and the bobbin 2 can be sized as appropriate according to the length, thickness, and material of threads to be wound.

[Thread Layer 3]

Figure 3A:
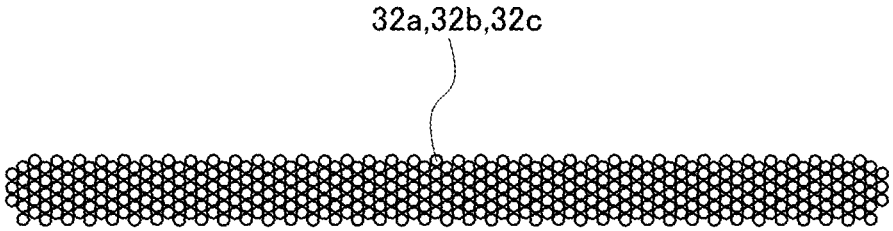
FIG. 3A is a schematic cross-sectional view of a multi-filament thread.
Figure 3B:
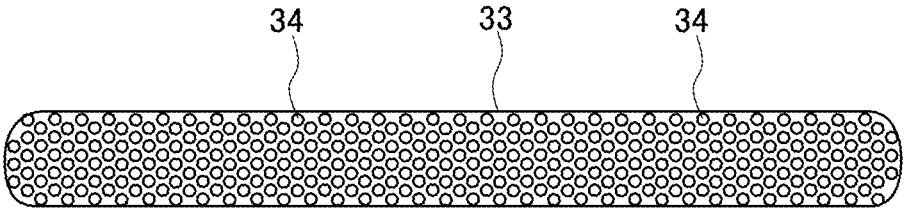
FIG. 3B is a schematic cross-sectional view of a tape-like thread.
Figure 4A:
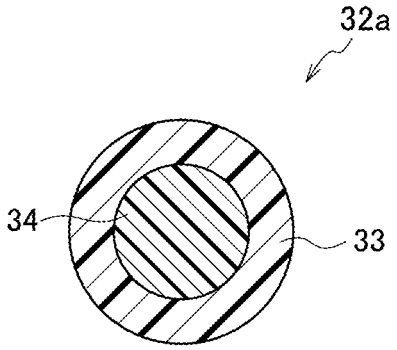
FIGS. 4A, 4B and 4C are cross-sectional views of structure examples of a composite fiber (single fiber) used for a multi-filament thread or tape-like thread.
Figure 4B:
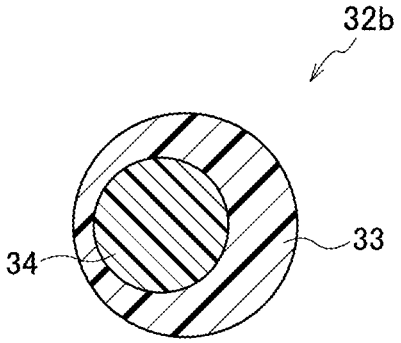
Figure 4C:
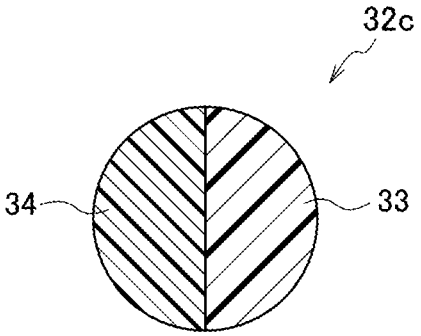

The thread layer 3 is formed by winding a plurality of threads 31*a* and 31*b* around the bobbin 2 by a traverse method. The threads 31*a* and 31*b* constituting the thread layer 3 are multi-filament threads or tape-like threads made of several tens to several hundreds of single fibers. The single fibers can be composite fibers made of two kinds of thermoplastic resins different in melting point, for example. FIG. 3A is a schematic cross-sectional view of a multi-filament thread, and FIG. 3B is a schematic cross-sectional view of a tape-like thread. FIG. 4A, FIG. 4B and FIG. 4C are cross-sectional views of structure examples of a composite fiber (single fiber) to be used for a multi-filament thread and tape-like thread, and FIG. 4A illustrates a sheath-core type, FIG. 4B illustrates an eccentric sheath-core type, and FIG. 4C illustrates a side-by-side type.

The "multi-filament thread" is formed by stranding a plurality of single fibers such as composite fibers 32*a*, 32*b*, and 32*c* into one thread (bundle) as illustrated in FIG. 3A. The composite fibers 32*a*, 32*b*, and 32*c* are made from a first resin ingredient (hereinafter, called low melting-point ingredient 33) and a second resin ingredient (hereinafter, called high melting-point ingredient 34) higher in melting point by 20° C. or more than the first resin ingredient. In the case of using the sheath-core-type composite fiber 32*a* illustrated in FIG. 4A and the eccentric sheath-core-type composite fiber 32*b* illustrated in FIG. 4B, the sheath part is formed from the low melting-point ingredient 33 and the core part is formed from the high melting-point ingredient 34.

On the other hand, the "tape-like thread" is formed by bonding and binding single fibers such as the composite fibers 32*a*, 32*b*, and 32*c* into one thread. For example, in the case of using the sheath-core-type composite fiber 33*a* illustrated in FIG. 4A or the eccentric sheath-core-type composite fiber 33*b* illustrated in FIG. 4B as the single fibers, the tape-like thread is structured such that island parts formed from the high melting-point ingredient 34 exist in a sea part formed from the low melting-point ingredient 33 as illustrated in FIG. 3B. The single fibers constituting a multi-filament thread or tape-like thread are not limited to the composite fibers described above but may be single fibers made from a single resin, or a mixture of a single fiber and a composite fiber may be used. In addition, the composite fiber can have a structure other than those illustrated in FIGS. 4A to 4C such as a multi core-type composite fiber.

The multi-filament threads and the tape-like threads used in the wound thread package of the present embodiment preferably have a total fineness of 100 to 6400 dtex per thread from the viewpoints of obtained effects and practical use. In the case of using threads with a total fineness of less than 100 dtex per thread, the end parts are unlikely to bulge and thus the application of the present invention to those threads is less advantageous. On the other hand, threads with a total fineness of greater than 6400 dtex is of limited application. Such threads with a large fineness are likely to deform or overlap at the end parts when wound, which easily leads to a failure in winding figure other than bulges at the both end parts.

As illustrated in FIG. 2, in the wound thread package 1 of the present embodiment, the threads described above (the multi-filament threads or tape-like threads) 31*a* and 31*b* are wound and rolled in approximately parallel at intervals therebetween such that they do not cross or overlap each other. The threads 31*a* and 31*b* constituting the thread layer 3 are the same in traverse width w but are different from each other in traverse reverse position, and only the threads 31*a* or the threads 31*b* are wound at each of the end parts of the thread layer 3 as seen in a direction of an axis x. As a result, the number of threads wound at the both end parts as seen in the direction of the axis x is smaller than the number of threads wound at the center part as seen in the direction of the axis x, so that the thread layer 3 has steps 3*a* lower on the outside at the both end parts as seen in the direction of the axis x.

The "steps" are generated at the both end parts of the thread layer 3 because the diameter of the both end parts is smaller than the diameter of the center part as seen in the direction of the axis x. The steps can be observed as differences in the level of the outer surface in a side view. The shape of the corners of the steps 3*a* varies depending on the shape and state of the wound threads, and does not need to make a right angle but may be curved or inclined at sides.

[Producing Method]

Figure 5:
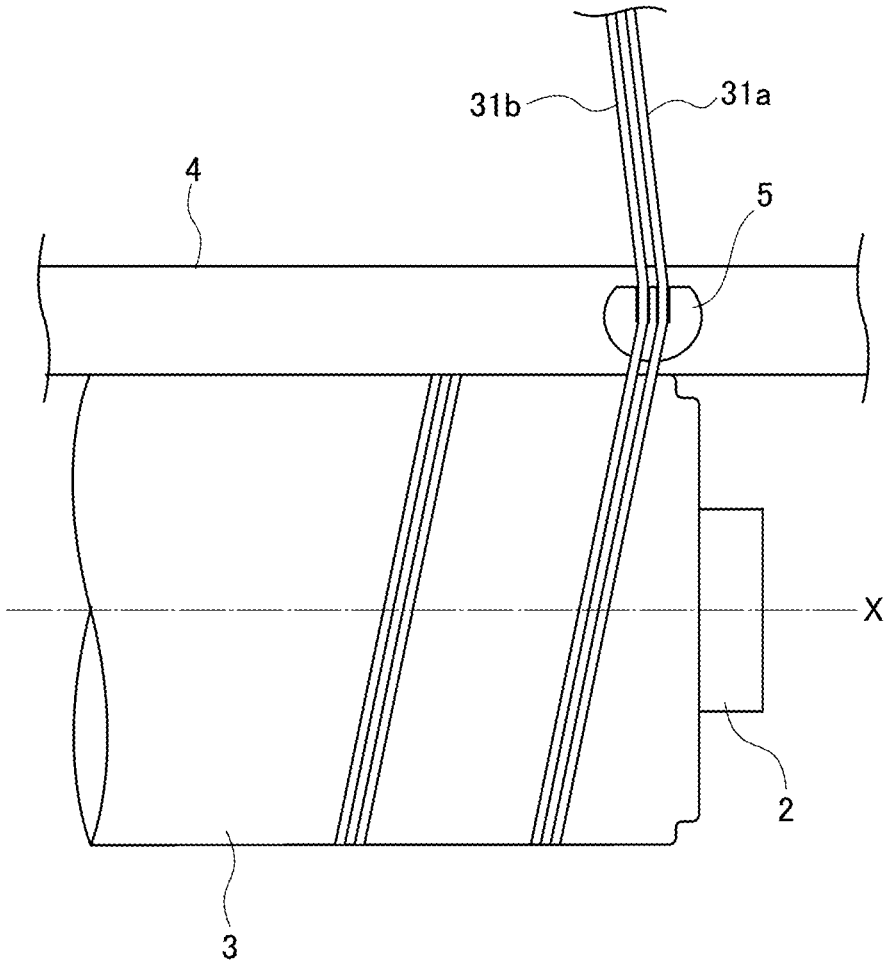
FIG. 5 is a diagram schematically illustrating a manufacturing method for the wound thread package 1 illustrated in FIG. 1.
Figure 6A:
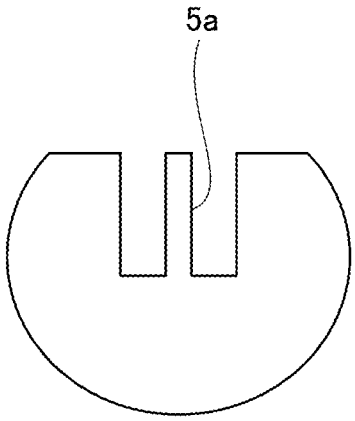
FIGS. 6A and 6B are diagrams illustrating examples of groove shapes of a traverse guide.
Figure 6B:
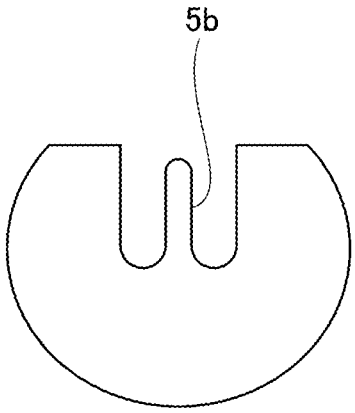

Next, a manufacturing method for the wound thread package 1 described above will be described. FIG. 5 is a diagram schematically illustrating a method for manufacturing the wound thread package 1 illustrated in FIG. 1. FIGS. 6A and 6B are diagrams illustrating examples of groove shapes in a traverse guide 5 illustrated in FIG. 5. As illustrated in FIG. 5, to manufacture the wound thread package 1 of the present embodiment, multi-filament threads or tape-like threads are wound around the bobbin 2 to form the thread layer 3.

According to the manufacturing method for the wound thread package 1 of the present embodiment, in a winding step, the number of threads wound at the both end parts as seen in the direction of the axis x is made smaller than the number of threads wound at the center part as seen in the direction of the axis x to form one or two or more steps 3*a* at the both end parts of the thread layer 3 as seen in the direction of the axis x. Specifically, a plurality of multi-filament threads or tape-like threads is arranged at intervals therebetween and is wound around the bobbin 2 so that the threads are the same in the traverse width w and are different from each other in the traverse reverse position.

At that time, when there are m (m is a natural number of 2 or more) multi-filament threads or tape-like threads to be wound at the same time, a traverse guide with m or more grooves is used. For example, as illustrated in FIG. 5, in the case of winding the two threads (multi-filament threads or tape-like threads) 31*a* and 31*b*, the traverse guide 5 with two or more grooves 5*a* is used to perform the winding. This makes it possible to stably wind a plurality of threads at predetermined intervals kept therebetween.

The groove shape in the traverse guide 5 is not limited to a rectangular shape in a side view such as a groove 5*a* illustrated in FIG. 6A but may be a U shape in a side view as a groove 5*b* illustrated in FIG. 6B. The groove shape in the traverse guide 5 can be selected as appropriate according to the material and characteristics of the threads. The length of a partition wall between the grooves 5*a* and 5*b*, that is, the interval between the adjacent grooves 5*a* or 5*b* is preferably 0.3 mm or more from the viewpoint of ensuring the strength of the traverse guide 5, and is preferably 5 mm or less from the viewpoint of preventing a slack in the threads to be used in a doubled state.

Further, to suppress influence on the threads such as breakage during a traverse (reciprocating movement), the grooves 5*a* and 5*b* in the traverse guide 5 preferably have a certain degree of depth (length) with respect to the moving direction of the threads. There is no particular limitation on the material of the traverse guide 5 but the material of the traverse guide 5 is preferably a metallic material such as ceramics or stainless steel, a composite material obtained by sintering ceramics on the surface of a metallic material, or the like from the viewpoint of resistance to abrasion.

In this manner, the use of the traverse guide 5 having the plurality of grooves 5*a* or 5*b* at predetermined intervals therebetween makes it possible to produce a wound thread package in which the threads are different from each other in traverse reverse position with the winding width (traverse width) in the winding device kept constant. According to the manufacturing method for a wound thread package of the present embodiment, the pressure of contact between the bobbin 2 and the threads 31*a* and 31*b* applied by the contact roller 4 can be set to a constant value without the need to be changed according to the winding position like in conventional cases.

As described above in detail, the wound thread package of the present embodiment has a plurality of threads wound at intervals therebetween, and the threads constituting the thread layer are the same in traverse width and different in reverse position. Accordingly, in the thread layer of the wound thread package of the present embodiment, the number of would threads is smaller at the both axially end parts than at the axially center part. This forms one or two or more steps at the both axially end parts lower on the outside instead of bulges.

In the wound thread package of the present embodiment, the density of the threads is lower at the both end parts of the thread layer, and thus there occurs no bulge at the both end parts even when the wound threads are multi-filament threads or tape-like threads. This makes it possible to suppress cob-webbing and collapse at the time of unwinding. In addition, the wound thread package of the present embodiment has a constant traverse width and thus it is not necessary to add a part to the winding device or strictly controlling the traverse width at the time of winding. This makes it possible to manufacture a wound thread package without no bulge at the both end parts by almost the same operations as conventional ones.

(Modification Example of the First Embodiment)

Next, a wound thread package according to a modification example of the first embodiment of the present invention will be described. In relation to the first embodiment, an example of a package in which two threads are wound around one bobbin with one step at the both end parts of the thread layer has been described above. However, the present invention is not limited to this but a wound thread package can be formed such that three or more threads are wound with two or more steps at the both end parts of the thread layer.

Figure 7:
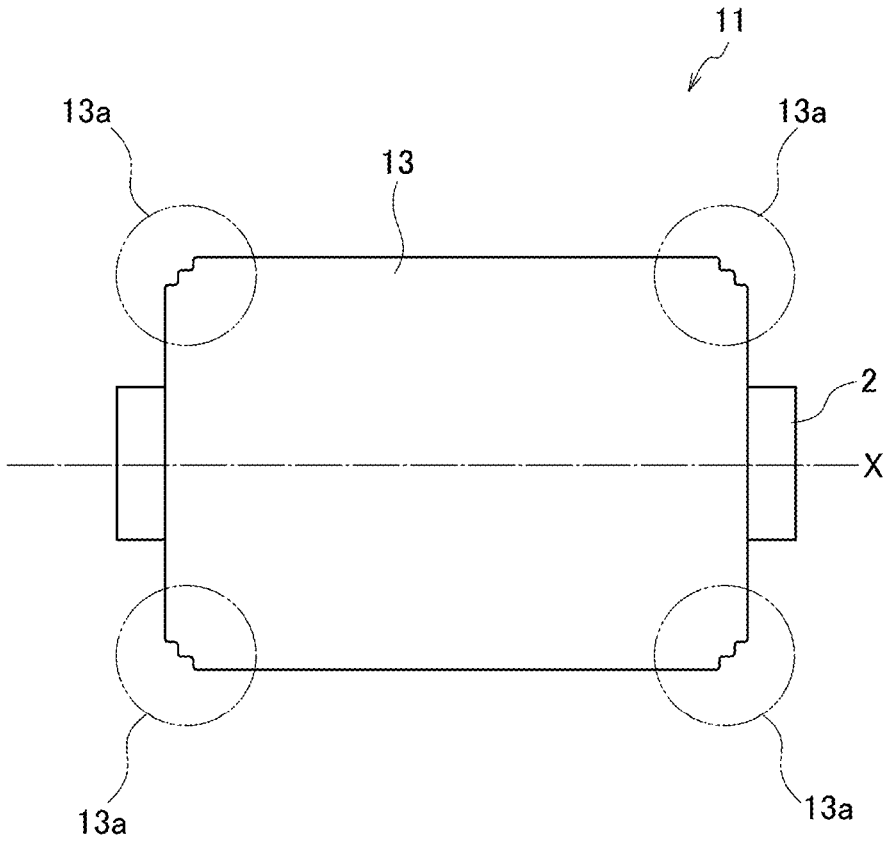
FIG. 7 is a side view of an outer shape of a wound thread package in a modification example of the first embodiment of the present invention.

FIG. 7 is a side view of an outer shape of a wound thread package in the modification example of the first embodiment of the present invention. As illustrated in FIG. 7, in the wound thread package 11 of the present modification example, three threads are traverse-wound around a bobbin 2 at intervals therebetween with steps 13*a* formed to be lower at two stages outward at both end parts of a thread layer 13 as seen in an axis x direction.

The wound thread package 11 of the present modification example can be manufactured by arranging three multi-filament threads or tape-like threads at intervals therebetween and winding the threads around the bobbin 2 such that the threads are the same in a traverse width w and different from each other in a traverse reverse position. Accordingly, the two-stage steps 13*a* are formed at the both end parts of the thread layer 13 as seen in the direction of the axis x.

In the wound thread package 11 of the present modification example, as in the wound thread package of the first embodiment described above, the number of threads wound is smaller at the both end parts as seen in the direction of the axis x than at the center part as seen in the direction of the axis x. Accordingly, the density of threads at the both end parts of the thread layer is low, thereby to suppress bulges at the both end parts. As a result, even with multi-filament threads or tape-like threads, it is possible to achieve a wound thread package that is unlikely to cause cob-webbing or collapse at the time of unwinding. The components and advantageous effects of the present modification example other than the ones described above are similar to those of the first embodiment.

EXAMPLES

Hereinafter, specific advantageous effects of the present invention will be described taking examples and comparative examples. As for the examples, the wound thread packages of the first embodiment were manufactured using multi-filament threads or tape-like threads and were evaluated for their outer shapes and unwinding properties. In addition, for a comparison purpose, other wound thread packages were manufactured by a conventional method and were evaluated for their outer shapes and unwinding properties by the same method.

First Example (1) Production of Threads

First, tape-like threads were produced from the sheath-core-type composite fibers illustrated in FIG. 4A by a method described below, using a random copolymer of ethylene and polypropylene (CoPP) with a melting point of 134° C. as a sheath ingredient and using a polyethylene terephthalate (PET) with a melting point 256° C. as a core ingredient.

Specifically, the sheath-core composite fibers were spun by a common hot melt composite spinning device using a sheath-core concentric-type composite nozzle with 120 nozzle holes at a spinning speed (the speed of first stretching rollers) of 66.2 m/minute, and then the 120 filaments were divided into two parts, 60 each filaments, by a separation guide. Subsequently, the fibers were thermally stretched between rollers at a stretching temperature of 100° C. and a stretching speed (the speed of second stretching rollers) of 274.0 m/minute. Further, the fibers were brought into contact with a heating nelson roller at a temperature of 158° C. at the same speed to melt only the CoPP as a low melting-point ingredient and integrate the fibers, thereby to obtain two tape-like threads.

(2) Winding

Next, a winding machine including a traverse device was used to wind the two tape-like threads produced by the method described above around a bobbin using a traverse guide with two grooves. The winding bobbin was a paper tube with an outer diameter of 108 mm and a length of 330 mm. The width of the grooves in the traverse guide was a width of 2.0 mm, and the width of a partition wall between the grooves (groove interval) was 1.0 mm.

The threads were wound under the conditions that the number of winds was 5.044 per traverse width (280 mm) and the winding speed was 275 m/minute. At that time, the winding was performed until the mass of the thread layer becomes 4.5 kg under a winding tension degree of 0.113 cN/dtex, with a contact load of 60.76 N on the bobbin (the pressing force applied to the winding bobbin by the contact roller), and at a contact pressure degree of 2.17 N/cm, thereby producing a wound thread package in a first example.

Second Example

Sheath-core composite fibers were spun using the same material, method, and conditions as those in the first example and were thermally stretched between rollers at a stretching temperature of 100° C. and at a stretching speed (the speed of second stretching rollers) of 274.0 m/minute. Then, at the same speed, the fibers were brought into contact with a heating nelson roller at a temperature of 120° C., thereby to obtain two (bundles of) multi-filament threads. The two (bundles of) multi-filament threads were wound around a bobbin (paper tube) by the same method and under the same conditions as those in the first example, thereby to obtain a wound thread package in a second example.

Third Example

In a spinning step, sheath-core composite fibers were spun from the same material as that in the first example, using a sheath-core concentric-type composite nozzle with 480 nozzle holes, at a spinning speed (the speed of first stretching rollers) of 66.2 m/minute, with the amount of a resin for both the sheath and the core discharged from a hot melt composite spinning device that is four times larger than that in the first example. At this time, the 480 filaments were divided into two parts, 240 each filaments, by a separation guide, thereby to obtain two tape-like threads on the other conditions that are the same as those in the first example. The two tape-like threads were wound around a bobbin (paper tube) by the same method and under the same conditions as those in the first example except for using a traverse guide in which the number of grooves were two, the width of the grooves was 5.0 mm, and the width of a partition wall between the grooves (groove interval) was 1.0 mm, thereby to obtain a wound thread package in a third example.

Fourth Example

Two tape-like threads were produced from the same material as that in the first example by the same method and under the conditions as those in the first example except that, in a spinning step, the amount of a resin for both the sheath and the core discharged from a hot melt composite spinning device was decreased to ¼. The two tape-like threads were wound around a bobbin (paper tube) by the same method and under the same conditions as those in the first example except for using a traverse guide in which the number of grooves was two, the width of the grooves was 0.3 mm, and the width of a partition wall between the grooves (groove interval) was 1.0 mm, thereby to obtain a wound thread package in a fourth example.

Fifth Example

Two tape-like threads were produced using the same material, method, and conditions as those in the first example. The two tape-like threads were wound around a bobbin (paper tube) by the same method and under the same conditions as those in the first example except for using a traverse guide in which the number of grooves was two, the width of the grooves was 2.0 mm, and the width of a partition wall between the grooves (groove interval) was 5.0 mm, thereby to obtain a wound thread package in a fifth example.

Sixth Example

Two tape-like threads were produced using the same material, method, and conditions as those in the first example. The two tape-like threads were wound around a bobbin (paper tube) by the same method and under the same conditions as those in the first example except for using a traverse guide in which the number of grooves was two, the width of the grooves was 2.0 mm, and the width of a partition wall between the grooves (groove interval) of 0.3 mm, thereby to obtain a wound thread package in a sixth example.

Seventh Example

Three tape-like threads were produced from the same material as that in the first example by the same method and under the same conditions as those in the first example except that, in a spinning step, the amount of a resin for both the sheath and the core charged from a hot melt composite spinning device was increased to 1.5 times, and the 120 filaments were divided into three parts, 40 each filaments, by a separation guide. The three tape-like threads were wound around a bobbin (paper tube) by the same method and under the same conditions as those in the first example except for using a traverse guide in which the number of grooves was three, the width of the grooves was 2.0 mm, and the width of a partition wall between the grooves (groove interval) was 1.0 mm, thereby to obtain a wound-thread package in a seventh example.

Eighth Example

Five tape-like threads were produced from the same material as that in the first example by the same method and under the same conditions as those in the first example except that, in a spinning step, the amount of a resin for both the sheath and the core charged from a hot melt composite spinning device was increased to 2.5 times, and 120 filaments were divided into five parts, 24 each filaments, by a separation guide. The five tape-like threads were wound around a bobbin (paper tube) by the same method and under the same conditions as those in the first example except for using a traverse guide in which the number of grooves was five, the width of the grooves was 2.0 mm, and the width of a partition wall between the grooves (groove interval) was 1.0 mm, thereby to obtain a wound-thread package in an eighth example.

Ninth Example

Two tape-like threads were produced from the same material as that in the first example by the same method and under the same conditions as those in the first example except that, in a spinning step, the amount of a resin for both the sheath and the core discharged from a hot melt composite spinning device was increased to 8 times that in the first example, a sheath-core concentric-type composite nozzle with 480 nozzle holes was used, and the 480 filaments were divided into two parts, 240 each filaments, by a separation guide. The two tape-like threads were wound around a bobbin (paper tube) by the same method and under the same conditions as those in the first example except for using a traverse guide in which the number of grooves was two, the width of the grooves was 5.0 mm, and the width of a partition wall between the grooves (groove interval) was 1.0 mm, thereby to obtain a wound-thread package in a ninth example.

First Comparative Example

Sheath-core composite fibers were obtained from the same material as that in the first example by the same method and under the same conditions as those in the first example except that a sheath-core concentric-type composite nozzle with 120 nozzle holes was used and the 120 filaments were spun as one fiber bundle without separation. The sheath-core composite fibers were stretched by the same method and under the same conditions as those in the second example, thereby to obtain one (bundle of) multi-filament thread. The one (bundle of) multi-filament thread was wound around a bobbin (paper tube) by the same method and under the same conditions as those in the first example except for using a traverse guide with one 2.0-mm wide groove, thereby to obtain a wound thread package in a first comparative example.

Second Comparative Example

Two tape-like threads produced using the same material, method, and conditions as those in the first example were wound around a bobbin (paper tube) by the same method and under the same conditions as those in the first example except that the two tape-like threads were wound as one bundle by a traverse guide with one 2.0 mm-width groove, thereby to obtain a wound thread package in a second comparative example.

Third Comparative Example

A wound thread package in a third comparative example was obtained using the same material, method, and conditions as those in the second comparative example except that, in order to suppress bulges at both end parts of a thread layer, the contact load on a bobbin (the pressing force applied to the winding bobbin by a contact roller) was 95.06 N and the degree of contact pressure was 3.40 N/cm. In the third comparative example, the degree of contact pressure was increased by 56% as compared to that in the second comparative example.

Fourth Comparative Example

Sheath-core composite fibers were obtained from the same material as that in the first example by the same method and under the same conditions as those in the first example except that, in a spinning step, the amount of a resin for both the sheath and the core discharged from a hot melt composite spinning device was increased to 12.5 times and the 480 filaments were divided into two parts, 240 each filaments, by a separation guide. The sheath-core composite fibers were stretched by the same method and under the same conditions as those in the second example, thereby to obtain two (bundles of) multi-filament threads.

The two (bundles of) multi-filament threads were wound around a bobbin (paper tube) by the same method and under the same conditions as those in the first example except for using a traverse guide in which the number of grooves was two, the width of the grooves was 5.0 mm, and the width of a partition wall between the grooves (groove interval) was 1.0 mm, thereby to obtain a wound thread package in a fourth comparative example.

[Evaluations]

Next, the wound thread packages in the first to ninth examples and the first to fourth comparative examples produced by the methods described above were evaluated by the methods described below.

(a) Package Shape

In the wound thread packages of the examples and the comparative examples, the outer winding diameters of the center part and both end parts, the width of steps at the both end parts, if they exist, the distance between adjacent threads, the pitch of threads, the width of wound threads, and the like were measured. The outer winding diameter of the both end parts refers to the outer diameter of the endmost portions as seen in the direction of the axis x, and the outer winding diameter of the center part refers to the nominal outer diameter of the wound thread package excluding the both end parts as seen in the direction of the axis x. This is defined as the outer winding diameter of the center part because it is typified by the outer diameter of the center part and its vicinity.

(b) Physical Properties of Threads

In the wound thread packages of the examples and the comparative examples, the widths and thicknesses of the threads wound around the bobbins were respectively measured by a digital caliper and a dial thickness gauge. Each of the wound thread packages was measured in a state where the threads of traverse turn parts (end parts as seen in the direction of the axis x) were wound around the bobbin in parallel to each other.

(c) The Presence or Absence of Winding Collapse

The outer appearances of the wound thread packages in the examples and the comparative examples were observed. The shape of the wound thread package with wound side surfaces (the end surfaces of the thread layer) swelling, not vertical to the winding direction of the bobbin (the direction of the axis x), was regarded as "saddle shape", and the shape of the wound thread package with the wound end parts (the end parts of the thread layer as seen in the direction of the axis x) bulging was regarded as "dumbbell shape". The wound thread package found to have either one of these shapes was evaluated to "have a winding collapse". On the other hand, the wound thread package found to have none of the "saddle shape" and the "dumbbell shape" was evaluated to "have no winding collapse".

(d) The Presence or Absence of Cob-Webbing

The outer appearances of the wound thread packages in the examples and the comparative examples were observed. The wound thread package found to be in a state in which the tape-like threads or the multi-filament threads were fallen from the winding end parts of the bobbin (the end parts of the thread layer as seen in the direction of the axis x) toward the winding side surfaces by 15 mm or more, that is, the threads took a short-cut, was evaluated to "have cob-webbing". On the other hand, the wound thread package found not to be in such a state, was evaluated to "have no cob-webbing".

(e) Unwinding Test

Figure 8:
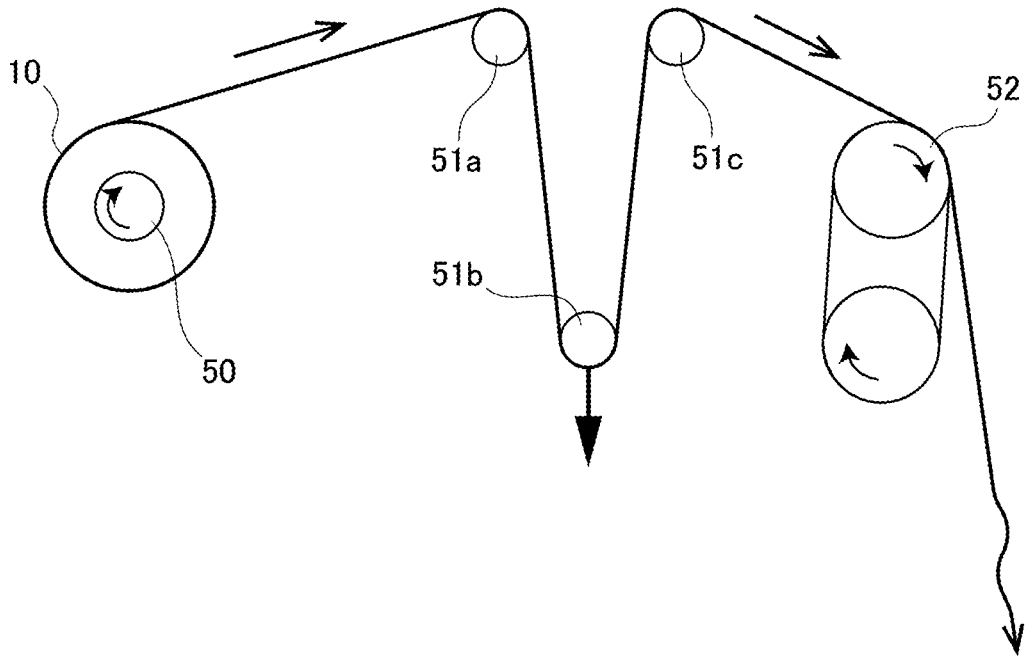
FIG. 8 is a diagram schematically illustrating a method for unwinding test of a thread in an example of the present invention.

FIG. 8 is a diagram schematically illustrating an unwinding test method. To perform the unwinding test, first, each of the bobbins in the wound thread packages 10 of the examples and the comparative examples was inserted into a rotation shaft 50, and the threads were passed over pick-up rollers 51*a* to 51*c* in a feeding machine with a back tensioner such that the threads came into a vertically picked-up state as illustrated in FIG. 8. Then, the tensile force was set such that the back tension (delivery tensile force) became 0.075 g/dtex (=0.074 cN/dtex).

After that, in the vertically picked-up state, the threads were unwound from the wound thread package and delivered by a delivery roller 52 such as a nelson roller at a speed of 120 m/minute. As a result, when the threads have been delivered without problem up to 85% or more of the entire winding length, the wound thread package was evaluated as having "no problem". When the threads were fallen from the end surfaces and cut during delivery, the wound thread package was evaluated as having "thread breakage".

Table 1 and Table 2 summarize the test results.

TABLE 1

| | | First example | Second example | Third example | Fourth example | Fifth example |
|---|---|---|---|---|---|---|
| Thread | Type | Tape-like | Multi-filament | Tape-like | Tape-like | Tape-like |
| | Number of threads | 2 | 2 | 2 | 2 | 2 |
| | Total fineness (dtex/thread) | 800 | 800 | 3200 | 200 | 800 |
| | Width (mm) | 1.2 | 1.0 | 4.8 | 0.3 | 1.2 |
| | Thickness (mm) | 0.1 | 0.1 | 0.1 | 0.1 | 0.1 |
| Package | Outer winding diameter at center part (mm) | 180 | 180 | 180 | 180 | 180 |
| | Outer winding diameter at both end parts (mm) | 179 | 179 | 179 | 179 | 179 |
| | Number of step(s) | 1 | 1 | 1 | 1 | 1 |
| | Width of step(s) (mm) | 3.2 | 3.1 | 5.6 | 0.9 | 7.3 |
| | Distance between threads (mm) | 2.1 | 2.0 | 4.4 | 1.2 | 5.7 |
| | Pitch of threads (mm) | 3.3 | 3.0 | 9.2 | 1.5 | 6.9 |
| | Total width of threads (mm) | 4.5 | 4.0 | 14.0 | 1.8 | 8.1 |
| | Winding collapse | Not found | Not found | Not found | Not found | Not found |
| | Cob-webbing | Not found | Not found | Not found | Not found | Not found |
| | Unwinding test | No problem in 25 km | No problem in 25 km | No problem in 6.3 km | No problem in 100 km | No problem in 25 km |

TABLE 1-continued

| | | Sixth example | Seventh example | Eighth example | Ninth example |
|---|---|---|---|---|---|
| Thread | Type | Tape-like | Tape-like | Tape-like | Tape-like |
| | Number of threads | 2 | 3 | 5 | 2 |
| | Total fineness (dtex/thread) | 800 | 800 | 800 | 6400 |
| | Width (mm) | 1.2 | 1.2 | 1.2 | 4.8 |
| | Thickness (mm) | 0.1 | 0.1 | 0.1 | 0.2 |
| Package | Outer winding diameter at center part (mm) | 180 | 180 | 180 | 180 |
| | Outer winding diameter at both end parts (mm) | 179 | 179 | 179 | 179 |
| | Number of step(s) | 1 | 2 | 4 | 1 |
| | Width of step(s) (mm) | 2.6 | [Inside to outside] 3.2/3.1 | [Inside to outside] 3.2/3.1/ 3.1/3.0 | 5.6 |
| | Distance between threads (mm) | 1.5 | 2.1 | 2.1 | 4.4 |
| | Pitch of threads (mm) | 2.7 | 3.3 | 3.3 | 9.2 |
| | Total width of threads (mm) | 3.9 | 7.8 | 14.4 | 14.0 |
| | Winding collapse | Not found | Not found | Not found | Not found |
| | Cob-webbing | Not found | Not found | Not found | Not found |
| | Unwinding test | No problem in 25 km | No problem in 16 km | No problem in 10 km | No problem in 3.1 km |

TABLE 2

| | | First comparative example | Second comparative example | Third comparative example | Fourth comparative example |
|---|---|---|---|---|---|
| Thread | Type | Multi-filament | Tape-like | Tape-like | Multi-filament |
| | Number of threads | 1 | 2 | 2 | 2 |
| | Total fineness (dtex/thread) | 1600 | 800 | 800 | 10000 |
| | Width (mm) | 1.0 | 1.2 | 1.2 | 5.3 |
| | Thickness (mm) | 0.2 | 0.1 | 0.1 | 0.32 |
| | Outer winding diameter at center part (mm) | 180 | 180 | 180 | 180 |
| Package | Outer winding diameter at both end parts (mm) | 190 | 185 | 180 | 179 |
| | Number of step(s) | 0 | 0 | 0 | 1 |
| | Width of step(s) | — | — | — | 10 |
| | Distance between threads (mm) | — | 0 | 0 | 1.8 |
| | Pitch of threads (mm) | — | 0 | 0 | 7.1 |
| | Total width of threads (mm) | 1.0 | 2.3 | 2.3 | 12.4 |
| | Winding collapse | Found (dumbbell shape) | Found (dumbbell shape) | Found (saddle shape) | Found (partial fall) |
| | Cob-webbing | Not found | Not found | Found | Found |
| | Unwinding test | Thread breakage | Thread breakage | Thread breakage | Thread breakage |

As shown in Table 2, the wound thread packages in the first to fourth comparative examples produced by conventional methods were evaluated to have "saddle shape" or "dumbbell shape" and have "winding collapse" or "cob-webbing." In contrast to this, as shown in Table 1, the wound thread packages in the first to ninth examples produced within the scope of the present invention were evaluated to have favorable shapes and be excellent in unwinding properties.

Specifically, in the wound thread package of the first example, the winding outer diameter of a center part was 180 mm, the winding outer diameter of both end parts was 179 mm, the number of step at the both end parts was one, and the width of the step was 3.2 mm. The distance between the adjacent tape-like threads was 2.1 mm, the pitch of the adjacent tape-like threads was 3.3 mm, and the width of the two wound threads was 4.5 mm. Further, the tape-like threads in the wound thread package of the first example had a fineness of 800 dtex, a width of 1.2 mm, and a thickness of 0.1 mm.

In the wound thread package of the first example, the threads wound around the bobbin did not cross each other, and so too with the wound thread packages in the second to ninth examples described below. This is possibly because, even if two or more threads are wound around a bobbin, the threads are regulated to be wound in approximately parallel to each other by a plurality of grooves provided in a traverse guide. The wound thread package in the first example had no "winding collapse" or "cob-webbing" and the threads were delivered without breakage over a length of 25 km at the unwinding test.

In the wound thread package of the second example, the winding outer diameter of a center part was 180 mm, the winding outer diameter of both end parts was 179 mm, the number of step at the both end parts was one, and the width of the step at the both end parts was 3.1 mm. The distance between the adjacent threads was 2.0 mm, the pitch of the adjacent threads was 3.0 mm, and the width of the two wound threads was 4.0 mm. Further, the multi-filament threads in the wound thread package of the second example had a fineness of 800 dtex, a width of 1.0 mm, and a thickness of 0.1 mm. The wound thread package in the second example had no "winding collapse" or "cob-webbing" and the threads were delivered without breakage over a length of 25 km at the unwinding test.

In the wound thread package of the third example, the winding outer diameter of a center part was 180 mm, the winding outer diameter of both end parts was 179 mm, the number of step at the both end parts was one, and the width of the step at the both end parts was 5.6 mm. The distance between the adjacent tape-like threads was 4.4 mm, the pitch of the adjacent tape-like threads was 9.2 mm, and the width of the two wound threads was 14 mm. Further, the tape-like threads in the wound thread package of the third example had a fineness of 3200 dtex, a width of 4.8 mm, and a thickness of 0.1 mm. The wound thread package in the third example had no "winding collapse" or "cob-webbing" but the threads were delivered without breakage over a length of 6.3 km at the unwinding test.

In the wound thread package of the fourth example, the winding outer diameter of a center part was 180 mm, the winding outer diameter of both end parts was 179 mm, the number of step at the both end parts was one, and the width of the step at the both end parts was 0.9 mm. The distance between the adjacent tape-like threads was 1.2 mm, the pitch of the adjacent tape-like threads was 1.5 mm, and the width of the two wound threads was 1.8 mm. Further, the tape-like threads in the wound thread package of the fourth example had a fineness of 200 dtex, a width of 0.3 mm, and a thickness of 0.1 mm. The wound thread package in the fourth example had no "winding collapse" or "cob-webbing" but the threads were delivered without breakage over a length of 100 km at the unwinding test.

In the wound thread package of the fifth example, the winding outer diameter of a center part was 180 mm, the winding outer diameter of both end parts was 179 mm, the number of step at the both end parts was one, and the width of the step at the both end parts was 7.3 mm. The distance between the adjacent tape-like threads was 5.7 mm, the pitch of the adjacent tape-like threads was 6.9 mm, and the width of the two wound threads was 8.1 mm. Further, the tape-like threads in the wound thread package of the fifth example had a fineness of 800 dtex, a width of 1.2 mm, and a thickness of 0.1 mm. The wound thread package in the fifth example had no "winding collapse" or "cob-webbing", and the threads were delivered without breakage over a length of 25 km at the unwinding test.

In the wound thread package of the sixth example, the winding outer diameter of a center part was 180 mm, the winding outer diameter of both end parts was 179 mm, the number of step at the both end parts was one, and the width of the step at the both end parts was 2.6 mm. The distance between the adjacent tape-like threads was 1.5 mm, the pitch of the adjacent tape-like threads was 2.7 mm, and the width of two wound threads was 3.9 mm. Further, the tape-like threads in the wound thread package of the sixth example had a fineness of 800 dtex, a width of 1.2 mm, and a thickness of 0.1 mm. The wound thread package in the sixth example had no "winding collapse" or "cob-webbing", and the threads were delivered without breakage over a length of 25 km at the unwinding test.

In the wound thread package of the seventh example, the winding outer diameter of a center part was 180 mm, the winding outer diameter of both end parts was 179 mm, and the number of steps at the both end parts was two, the width of the inside step was 3.2 mm, and the width of the outer step was 3.1 mm. The distance between the adjacent tape-like threads was 2.1 mm, the pitch of the adjacent tape-like threads was 3.3 mm, and the width of three wound threads was 7.8 mm.

Further, the tape-like threads in the wound thread package of the seventh example had a fineness of 800 dtex, a width of 1.2 mm, and a thickness of 0.1 mm. The wound thread package in the seventh example had no "winding collapse" or "cob-webbing", and the threads were delivered without breakage over a length of 16 km at the unwinding test.

In the wound thread package of the eighth example, the winding outer diameter of a center part was 180 mm, the winding outer diameter of both end parts was 179 mm, and the number of steps at the both end parts was four. From the inside to outside, the first step had a width of 3.2 mm, the second step had a width of 3.1 mm, the third step had a width of 3.1 mm, and the fourth step had 3.0 mm. The distance between the adjacent tape-like threads was 2.1 mm, the pitch of the adjacent tape-like threads was 3.3 mm, and the width of five wound threads was 14.4 mm.

Further, the tape-like threads in the wound thread package of the eighth example had a fineness of 800 dtex, a width of 1.2 mm, and a thickness of 0.1 mm. The wound thread package in the eighth example had no "winding collapse" or "cob-webbing", and the threads were delivered without breakage over a length of 10 km at the unwinding test.

The tape-like threads in the wound thread package of the eighth example were separated into five in the wound state. At the delivery test simulating practical use, the total width of the five threads was broadly about 14 to 15 mm. When threads wound with a width of larger than 15 mm are bound into one for use at the time of delivery, the tensile force of the tape-like threads or the multi-filament threads at the both right and left ends tends to vertically fluctuate as compared to the tensile force at the center and its vicinity. In particular, the threads greatly fluctuate in tensile force and are likely to become loose at the time of passage through the turn portions at the both end parts as seen in the direction of the axis x. Therefore, a plurality of threads is preferably wound with a total width of 15 mm or less.

In the wound thread package of the ninth example, the winding outer diameter of a center part was 180 mm, the winding outer diameter of both end parts was 179 mm, the number of step at the both end parts was one, and the width of the step was 5.6 mm. The distance between the adjacent threads was 4.4 mm, the pitch of the adjacent threads was 9.2 mm, and the width of two wound threads was 14 mm. Further, the multi-filament threads in the wound thread package of the ninth example had a fineness of 6400 dtex, a width of 4.8 mm, and a thickness of 0.2 mm. The wound thread package in the ninth example had no "winding collapse" or "cob-webbing" but the threads were delivered without breakage over a length of 3.1 km at the unwinding test.

In contrast to this, in the wound thread package of the first comparative example in which one thread was traverse-wound by a conventional method, the winding outer diameter of the center part was 180 mm, and the winding outer diameter of the both end parts was 190 mm. The wound thread package had a winding shape in which the both end parts bulged with a width of about 10 mm (dumbbell shape) and was in the winding collapse state. The multi-filament thread in the wound thread package of the first comparative example had a fineness of 1600 dtex, a width of 1.0 mm, and a thickness of 0.2 mm.

The wound thread package in the first comparative example was formed by winding one bundle of multi-filament thread with a fineness of 1600 dtex. On the other hand, the wound thread package in the second example in which two bundles of multi-filament thread were wound with a fineness of 800 dtex. The total fineness 1600 dtex of the two bundles was the same as the fineness of the wound thread package in the first comparative example, but the second example did not cause winding collapse. As above, in the wound thread package of the first comparative example, the both end parts bulged as compared to the case in which threads are divided into two or more parts and wound as in the second example, possibly for the reason described below.

That is, at the center part and its vicinity of a winding bobbin, one bundle is wound up in such a manner as to cross one layer below of the wound thread at any time. However, at the both end parts of the winding bobbin, when the traverse turns in the opposite direction, the thread is once wound up in parallel to the rotation direction of the bobbin (parallel wound portions) for a short time, and then starts a crossing movement in the opposite direction. Accordingly, the parallel wound portions are accumulated and stacked at the both end parts of the thread layer, and bulge beyond the center part and its vicinity along with an increase in the winding diameter.

On the other hand, the wound thread package in the second example had a total fineness of 1600 dtex, but the wound threads were divided into two parts and thus only one bundle is always traversed at the both end parts of the thread layer to produce parallel winding. Accordingly, there occurred no phenomenon that the both end parts bulge in the wound thread package of the second example. When a thread is separated into two parts with the same fineness (½ separation) or when a thread is separated into a plurality of parts and wound such that the plurality of fiber bundles becomes similar in the fineness, the stack thickness becomes smaller (the winding outer diameter becomes smaller) with increasing proximity to the both end parts, thereby generating a step at the both end parts of the thread layer.

The number of steps generated increases in correspondence with the number of separated threads such that two separated threads generate one step and three separated threads generate two steps. Since the threads are wound in such a mechanism, it is considered that the both end parts of the thread layer in the present example tend to be lower in apparent fiber density than the center part and its vicinity. This is considered to apply to the case of winding tape-like threads.

At the unwinding test, in the wound thread package of the first comparative example, the threads wound at the dumbbell-shaped bunging portions became fallen from the winding end parts, entangled with each other, and broken when being delivered only 800 m (about 3% of the total winding length). As above, the wound thread package in the first comparative example was inferior in winding properties to the wound thread packages in the first to ninth examples described above.

In the wound thread package of the second comparative example in which two threads were collectively wound, the winding outer diameter of a center part was 180 mm, and the winding outer diameter of both end parts was 185 mm. The wound thread package had a winding shape (dumbbell shape) in which the both end parts bulged with a width of about 10 mm and was in a winding collapse state. This is because, since were wound in a state of being bound into one, the two tape-like threads overlapped each other at the both end parts of the thread layer where the traverse turned.

The tape-like threads in the wound thread package of the second comparative example had a fineness of 800 dtex, a width of 1.2 mm, and a thickness of 0.1 mm. At the unwinding test, in the wound thread package of the second comparative example, the tape-like threads wound at the dumbbell-shaped bulging portions became fallen from the winding end parts, entangled with each other, and broken when being delivered only 600 m (about 2% of the total winding length). As above, the wound thread package in the second comparative example was inferior in winding properties to the wound thread packages in the first to ninth examples described above.

In the wound thread package of the third comparative example in which the load of contact pressure by the contact roller was made greater than that in the second comparative example, the winding outer diameter of the center part was 180 mm and the winding outer diameter of the both end parts was 180 mm. The wound thread package did not have a dumbbell shape without a bulge at the both end parts. However, the wound thread package in the third comparative example had a "saddle shape" with the both end surfaces swelling and was in a winding collapse shape, and also had "cob-webbing". In the wound thread package of the third comparative example, the tape-like threads located on the lowest layer on the side surfaces of the both end parts as seen in the direction of the axis x were wound while being pushed outward from the winding end parts and bulging due to the increase in the contact pressure applied by the contact roller. The cob-webbing was considered to be caused by the same reason.

The tape-like threads in the wound thread package of the third comparative example had a fineness of 800 dtex, a width of 1.2 mm, and a thickness of 0.1 mm. The tape-like material at the endmost parts where the traverses of the winding end parts turned exhibited a trace of being wound while being compressed and had lint left. This has revealed that the threads became damaged. At the unwinding test, in the wound thread package of the third comparative example, the tape-like threads fell from the winding end parts in the places of cob-webbing, the threads became entangled with each other partially under the influence of the lint, and broken when being delivered only 800 m (about 3% of the total winding length). As above, the wound thread package in the third comparative example was inferior in usability to the first to ninth examples.

In the wound thread package of the fourth comparative example in which two bundles of 10000 dtex-multi-filament threads were wound by using a traverse guide with two grooves, the winding outer diameter of the center part was 180 mm and the winding outer diameter of the both end parts was 179 mm. No bulge was generated but a step was formed at the both end parts of the thread layer. In the wound thread package in the fourth comparative example, the number of the step formed at the both end parts of the thread layer was one and the width of the step was 10 mm. The distance between the adjacent threads was 1.8 mm, the pitch of the adjacent threads was 7.1 mm, and the width of the two wound threads was 12.4 mm.

However, in the wound thread package of the fourth comparative example, the fineness of the wound multi-filament threads was high, and thus the threads were partially fallen at the both winding end parts to cause winding collapse with cob-webbing. The multi-filament thread in the wound thread package of the fourth comparative example had a fineness of 10,000 dtex, a width of 5.3 mm, and a thickness of 0.32 mm. At the unwinding test, in the wound thread package of the fourth comparative example, the single fibers of the threads having caused cob-webbing became partially entangled with each other to cause thread breakage. Thus, the threads could not be delivered for use.

The foregoing results have revealed that, according to the present invention, it is possible to obtain a wound thread package that has no bulge at the both end parts and is unlikely to cause problems such as collapse at the time of unwinding and cob-webbing.

REFERENCE SIGNS LIST

1, 10, 11, 12 Wound thread package
2 Bobbin
3, 13 Thread layer
3*a*, 13*a* Step
4 Contact roller
5 Traverse guide
5*a*, 5*b* Groove
31*a*, 31*b* Thread
32*a*, 32*b*, 32*c* Composite fiber (single fiber)
33 First resin ingredient (low melting-point ingredient)
34 Second resin ingredient (high melting-point ingredient)
50 Rotation shaft
51*a*~51*c* Roller
52 Delivery roller

The invention claimed is:

1. A cross-wound thread package comprising:

a bobbin having an unflanged cylindrical shape; and thread layers that are formed by cross-winding a plurality of multi-filament threads or tape-like threads around the bobbin by a traverse method in a manner that nth thread layer and (n+1)th thread layer cross-wound each other, where n is a natural number, wherein the plurality of the multi-filament threads and the plurality of the tape-like threads are wound at intervals around the bobbin, each of the multi-filament threads is a singly-twisted thread of a plurality of composite fibers made of two or more kinds of thermoplastic resins having different melting points, or a singly-twisted thread made of the plurality of the composite fibers blended with fibers made of a single kind of resin, each of the tape-like threads is a unified thread made of the plurality of the composite fibers or a unified thread made of the plurality of the composite fibers blended with fibers made of a single kind of resin, the multi-filament threads and the tape-like threads have a total fineness of 100 to 6400 dtex per thread, and each of the plurality of multi-filament threads and the plurality of tape-like threads wound around the bobbin to have a same traverse width as, and a reverse position different from one another.

2. The wound thread package according to claim 1, wherein the thread layer is configured such that the number of threads wound is smaller at both axially end parts than at an axially center part so that one or two or more steps are formed at the both axially end parts.

3. A manufacturing method for a cross-wound thread package comprising a winding step of winding a plurality of multi-filament threads or a plurality of tape-like threads with a total fineness of 100 to 6400 dtex per thread around a bobbin having an unflanged cylindrical shape by a traverse method, winging at a time and at intervals therebetween in a manner that nth thread layer of the plurality of multi-filament threads or the plurality of tape-like threads and (n+1)th thread layer of the plurality of multi-filament threads or the plurality of tape-like threads cross-wound each other, where n is a natural number, wherein in the winding step, each of the plurality of multi-filament threads and the plurality of tape-like threads are wound to have a same traverse width wand has a reverse position different from each other, each of the multi-filament threads is a singly-twisted thread of a plurality of composite fibers made of two or more kinds of thermoplastic resins having different melting points, or a singly-twisted thread made of the plurality of the composite fibers blended with fibers made of a single kind of resin, and each of the tape-like threads is a unified thread made of the plurality of the composite fibers or a unified thread made of the plurality of the composite fibers blended with fibers made of a single kind of resin.

4. The manufacturing method for a wound thread package according to claim 3, wherein, in the winding step, the number of threads wound at both axially end parts is made smaller than the number of threads wound at an axially center part so that one or two or more steps are formed at the both axially end parts on the thread layer formed on the bobbin having the unflanged cylindrical shape.

5. The manufacturing method for a wound thread package according to claim 4, wherein m (m is a natural number of 2 or more) multi-filament threads or the tape-like threads are wound at a same time using a traverse guide having m or more grooves.

6. The manufacturing method for a wound thread package according to claim 5, wherein an interval between the grooves in the traverse guide is set to 0.3 to 5 mm.

7. The manufacturing method for a wound thread package according to claim 3, wherein m (m is a natural number of 2 or more) multi-filament threads or the tape-like threads are wound at a same time using a traverse guide having m or more grooves.

8. The manufacturing method for a wound thread package according to claim 7, wherein an interval between the grooves in the traverse guide is set to 0.3 to 5 mm.

* * * * *